United States Patent [19]

Kawakami

[11] 3,999,408

[45] Dec. 28, 1976

[54] BICYCLE LOCK

[76] Inventor: Shigeru Kawakami, 17-3, Higashi Shinkoiwa 6-chome, Katsushika, Tokyo, Japan

[22] Filed: May 21, 1975

[21] Appl. No.: 579,672

[52] U.S. Cl. ..... 70/18; 70/30

[51] Int. Cl.[2] ..... E05B 37/10; E05B 73/00

[58] Field of Search ..... 70/14, 15, 18, 22, 23, 70/30, 302, 303 R

[56] References Cited

UNITED STATES PATENTS

| | | | |
|---|---|---|---|
| 200,617 | 2/1878 | King et al. | 70/30 |
| 226,069 | 3/1880 | Hathaway | 70/18 X |
| 504,034 | 8/1893 | Hay | 70/15 X |
| 605,493 | 6/1898 | LeVino | 70/30 |
| 879,747 | 2/1908 | Crim et al. | 70/18 X |
| 1,468,027 | 9/1923 | Lindberg | 70/23 |

*Primary Examiner*—Robert L. Wolfe
*Attorney, Agent, or Firm*—Hauke & Patalidis

[57] ABSTRACT

A combination lock and a length of steel cable or chain connected with the ends of said lock. The lock comprises a bolt inserted in a casing. A shaft having combined knob and numeral wheel at one end is rotatably disposed in the casing which is provided with a numeral indicating window. Three step wheels, each having a peripheral recess, are loosely mounted on the shaft. The step wheels are provided with a projection or projections on one or both sides for transmitting the movements of the knob. The code number of the lock is composed of three numerals. To unlock, the knob is turned clockwise, until the first numeral of the code number appears in the window, which causes the first step wheel which is farthest from the numeral wheel to be brought to the release position wherein its peripheral recess lies just above the notch provided in the locking bolt; next, the knob is turned counterclockwise until the second numeral of the code number appears two times in the window, whereby the second step wheel is brought to the release position wherein its peripheral recess lies just above the notch of the bolt; finally, the knob is turned again clockwise until the last numeral of the code number appears in the window whereby the third step wheel is brought to the release position wherein its peripheral recess lies just above the corresponding notch of the bolt. Then, as all the step wheels are brought to release position, the bolt may be withdrawn from the casing. According to this invention, a double clip is provided in the casing in order to hold the first and second step wheels immobile against shock or vibration whereby no disturbance of the positions of said step wheels occur during unlocking operation. Further, according to this invention, as the numeral wheel is provided with six radial projections, by varying the relative positions between said projections and the cooperative projection provided on the third step wheel, six different code numbers will be obtained without changing the step wheels.

3 Claims, 14 Drawing Figures

FIG. 1
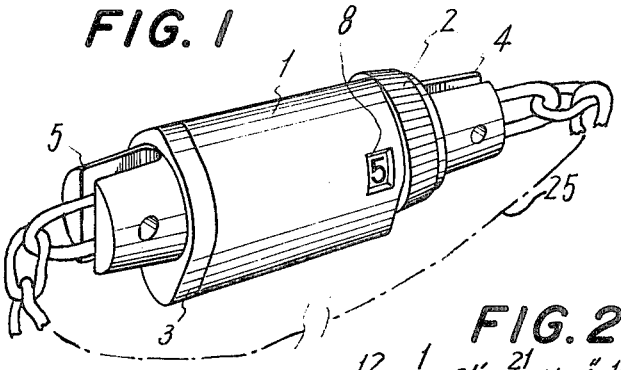
FIG. 7
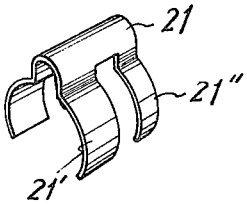
FIG. 2
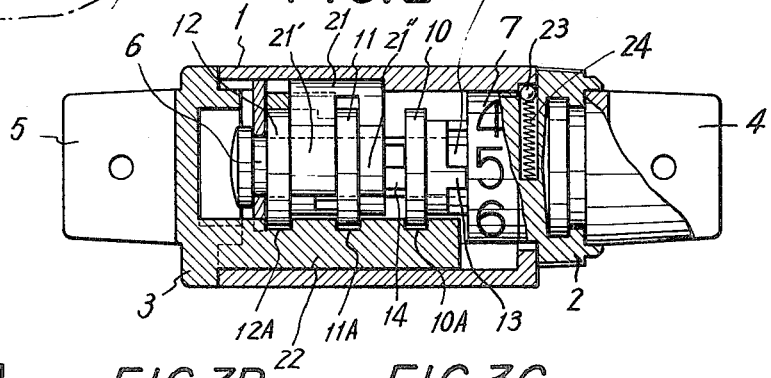
FIG. 3A
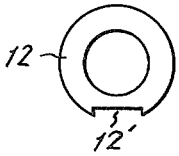
FIG. 3B
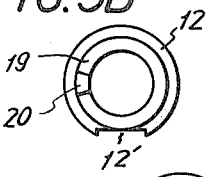
FIG. 3C
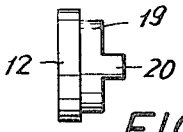
FIG. 4B
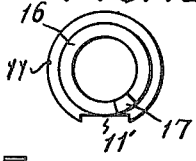
FIG. 4A
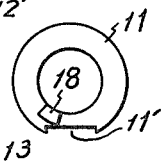
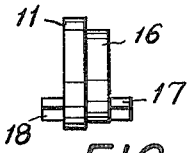
FIG. 4C
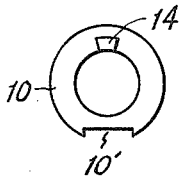
FIG. 5A
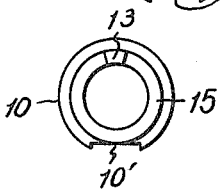
FIG. 5B
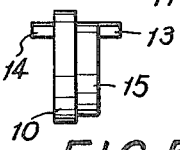
FIG. 5C
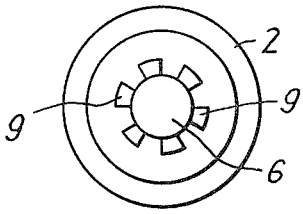
FIG. 6B
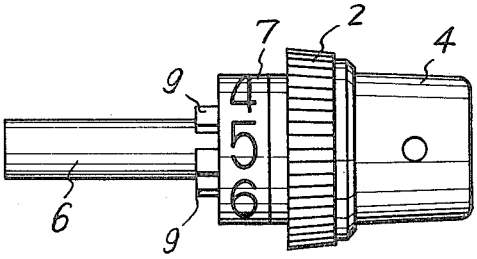
FIG. 6A

BICYCLE LOCK

BACKGROUND OF THE INVENTION

This invention relates to a bicycle lock consisting of a combination lock and a length of steel cable or chain connected with the ends of said lock.

The combination lock employed herein is novel in its construction. A shaft is rotatably arranged within the casing of the lock. One end of the shaft is secured to a knob and a numeral wheel which are formed in one body. Three step wheels, each having a recess in its periphery, are loosely mounted on the shaft. The locking bolt inserted in the casing is provided with three notches each corresponding to one of the step wheels. When at least one of the step wheels engages with a notch, the bolt cannot be withdrawn from the casing.

For unlocking, the knob is first turned clockwise until the first numeral of the code number appears in a window provided in the casing, whereby the first step wheel which is farthest from the numeral wheel is brought to the release position wherein its peripheral recess lies just above the corresponding notch of the locking bolt; next, the knob is turned counterclockwise until the second numeral of the code number appears two times in the window whereby the second step wheel is brought to the release position wherein its peripheral recess lies just above the corresponding notch of the locking bolt, and finally the knob is turned again clockwise until the final numeral of the code number is visible in the window whereby the third step wheel adjacent to the numeral wheel is brought to the release position wherein its peripheral recess lies just above the corresponding notch of the bolt. Then as all the step wheels disengage from the notches of the bolt, the bolt may be withdrawn from the casing.

It is to be noted that this invention provides against accidental movements of the first and the second step wheels. For this purpose, a double clip disposed in the casing is thrust on the flanged portions of the first and the second step wheels so as to hold them immobile. Since the positions of the step wheels are not disturbed, unlocking operation can be positively effected notwithstanding vibration or shock.

The diverse purposes and advantages of the invention and a better understanding thereof may be had by reference to the following description, taken in conjunction with the accompanying drawing, in which:

BRIEF DESCRIPTION OF THE DRAWING

FIG. 1 is a perspective view of the bicycle lock of the present invention;

FIG. 2 is a longitudinal sectional view thereof in the locked state;

FIG. 3*a* is a rear view, FIG. 3*b* is a front view, and FIG. 3*c* is a side view of the first step wheel;

FIG. 4*a* is a rear view, FIG. 4*b* is a front view, and FIG. 4*c* is a side view of the second step wheel;

FIG. 5*a* is a rear view, FIG. 5*b* is a front view, and FIG. 5*c* is a side view of the third step wheel;

FIG. 6*a* is a side view of the assembly of knob, numeral wheel and shaft;

FIG. 6*b* is a front view thereof; and

FIG. 7 illustrates a double clip.

DETAILED DESCRIPTION OF THE PREFERRED EMBODIMENT

As illustrated in the drawing, and more particularly at FIGS. 1 and 2, the lock of the invention comprises a tubular casing 1 having an end provided with a rotatable knob 2, while the other end of the casing is provided with a detachable cap 3. The knob is formed integral with a numeral wheel 7, and they are both secured to one end of the shaft 6, FIGS. 2 and 6. On one side of the numeral wheel, six radial projections 9 are formed. The shaft 6 is rotatably supported in the casing 1. A ball 23 and a spring 24 constitute a well known click mechanism to assure each rotating position of the knob 2. The numeral wheel 7 is placed within the casing 1 and its numeral is visible through a window 8 provided in one side of the casing 1.

On the shaft 6, three step wheels, namely first step wheel 12, second step wheel 11 and third step wheel 10 are loosely mounted. Each step wheel is provided with a recess in its periphery.

The first step wheel 12, FIGS. 3*a*–3*c*, which is farthest from the numeral wheel 7 is provided with a recess 12′ at its periphery and its flange member 19 is provided with a projection 20. The second step wheel 11, FIGS. 4*a*–4*c* is provided with a recess 11′ in its periphery and its flange member 16 as well as one side of the step wheel are provided with projections 17 and 18 respectively. The third step wheel 10, FIGS. 5*a*–5*c*, adjacent to the numeral wheel 7 is provided with a recess 10′ in its periphery, and its flange member 15 and one side of the step wheel is provided with projections 13 and 14 respectively.

The projection 13 of the third step wheel 10 is normally positioned between a pair of the projections 9 whereby the movement of the knob 2 is directly transmitted to the third step wheel 10, while the movement of the third step wheel 10 is transmitted to the second step wheel 11 through the engagement of the projections 14 and 17, and the movement of the second step wheel 11 is transmitted to the first step wheel 12 through the engagement of the projections 18 and 20.

According to this invention, a double clip 21, FIG. 7, is employed to prevent unwanted movements of the first and the second step wheels. Said double clip 21 is composed of two clip members 21′ and 21″. The joint of the double clip is inserted in a longitudinal groove formed in the inner surface of the casing 1 and the clip members 21′ and 21″ are resiliently and frictionally engaged with the flange members 19 and 16, respectively on the first and second step wheels 12 and 11, so as to keep the first and second step wheels immobilized notwithstanding shock or vibration, clip member 21′ further acting as a spacer between the step wheels 12 and 11, as shown at FIG. 2.

The cap 3 is secured to, or integral with, one end of a bolt 22. The bolt 22 is provided with three notches 12*a*, 11*a* and 10*a* which engage with portions of peripheries of the step wheels 12, 11 and 10 respectively in the locking position as shown in FIG. 2.

A length of steel cable or chain 25 is connected to connecting members 4 and 5 whereby said cable or chain and the lock forms a loop when said lock is in the locked position. The connecting member 5 is formed in one body with the cap 3 while the other connecting member 4 is rotatively attached to the knob 2.

The operation of the bicycle lock may now be described, assuming the code number is [4]–[6]–[2], for example.

For unlocking, first, the knob 4 is turned clockwise until numeral [4] is visible in the window 8 whereby the movement of the knob 2 is transmitted to the first step wheel 12 through the engagements of the projections 9 and 13, 14 and 17, and 18 and 20 in succession and the first step wheel 12 is brought to the position wherein its recess 12' is located just above the notch 12*a* provided in the bolt 22.

Next the knob 2 is turned counterclockwise until numeral [6] is visible in the window 8 two times whereby the movement of the knob 2 is transmitted to the second step wheel 11 through the cooperation of the projections 9, 13, 14 and 17 so as to bring the second step wheel 11 to the position wherein its recess 11' lies just above the notch 11*a* provided in the bolt 22. During the above-mentioned movement, the first step wheel 12 remains immobile due to the clamping action of the clip member 21' on the flange member 19 of the first step wheel.

Finally, the knob 2 is turned clockwise until numeral [2] is visible in the window 8 whereby the movement of the knob is transmitted only to the third step wheel 10 through the engagement of the projections 9 and 13 and the third step wheel is brought to the position wherein its recess 10' lies just above the notch 10*a* provided on the bolt 22, while the second step wheel 11 remains immobile due to the clamping action of the clip member 21'' on the flange member 16 of the second step wheel.

As is clear from the above description, by turning the knob 2 first one direction, next the opposite direction and finally the same direction as the first in accordance with the code number, all the recesses provided in the peripheries of three step wheels are brought one by one above the corresponding notches of the bolt 22, whereby the bolt is released from the grips of the step wheels and may be withdrawn from the casing 1.

In order to lock, after the steel cable or chain 24 is led around the rim of the front wheel and the front fork of a bicycle, and a post or the like, the bolt 22 is inserted in the casing 1 and the knob 2 is turned at random.

As the lock of the invention cannot be unlocked without knowledge of the code number as well as of the turning directions of the knob, the chances of having a bicycle stolen is considerably reduced.

Furthermore, as according to this invention, the numeral wheel 7 is provided with six radial projections 9, by varying the relative positions between the projections and the projection 13 of the third step wheel 10, six different code numbers will be obtained without changing any of the step wheels.

Although the present invention has been described as consisting of three step wheels, thereby providing a code number consisting of three digits, it will be readily apparent that only two step wheels could be used, thus providing for a two-digit code number, or more than three step wheels could be used, thus providing for a multi-digit code number.

Having thus described the present invention by way of a typical practical embodiment thereof, what is claimed as new is as follows:

1. A bicycle lock comprising:

a casing having a numeral indicating window;

a shaft rotatably supported in said casing;

an integrally formed knob and numeral wheel mounted at one end of said shaft;

at least a pair of step wheels loosely mounted on said shaft, each having a recess in its periphery and a reduced diameter cylindrical lateral flange;

means for transmitting the rotation of the knob to said step wheels;

a clip within the casing for preventing accidental movements of the step wheel which is farthest from the numeral, said clip having at least one clip member in frictional peripheral engagement with said step wheel lateral flange;

a locking bolt inserted in the casing having notches corresponding with said step wheels and having a cap at one end; and a length of steel cable or chain having an end connected to the cap and another end rotatably connected to said knob;

wherein the means for transmitting the rotation of the knob to the step wheels comprises a lateral projection on at least one side of said step wheels engageable with a lateral projection on the side of an adjacent step wheel, and a lateral projection on the side of said numeral wheel engageable with said projection on the side of said step wheel, and wherein said numeral wheel has a plurality of projections on the side thereof for engagement with the projection on the side of the adjoining step wheel, whereby the combination of said lock may be varied according to the location of said step wheel projection between said numeral wheel projections.

2. The bicycle lock of claim 1 wherein three step wheels are loosely mounted on said shaft and said locking bolt has three notches each corresponding to one of said step wheels.

3. The bicycle lock of claim 2 wherein said clip has a pair of said clip members for engaging the periphery of the lateral flange of respectively the step wheels farthest and next farthest from the numeral wheel, the clip member engaging the lateral flange of the step wheel farthest from the numeral wheel defining a spacer between said step wheels.

* * * * *